US011220803B2

(12) United States Patent
Ishijima et al.

(10) Patent No.: US 11,220,803 B2
(45) Date of Patent: Jan. 11, 2022

(54) CONSTRUCTION MACHINE

(71) Applicant: Hitachi Construction Machinery Co., Ltd., Tokyo (JP)

(72) Inventors: Makoto Ishijima, Omitama (JP); Seiji Ishida, Hitachinaka (JP); Kenta Tanigaki, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 678 days.

(21) Appl. No.: 16/081,754

(22) PCT Filed: Mar. 8, 2017

(86) PCT No.: PCT/JP2017/009171
§ 371 (c)(1),
(2) Date: Aug. 31, 2018

(87) PCT Pub. No.: WO2017/199546
PCT Pub. Date: Nov. 23, 2017

(65) Prior Publication Data

US 2021/0180293 A1 Jun. 17, 2021

(30) Foreign Application Priority Data

May 18, 2016 (JP) ..... JP2016-099529

(51) Int. Cl.
*F02D 29/04* (2006.01)
*E02F 9/20* (2006.01)
(Continued)

(52) U.S. Cl.
CPC ..... *E02F 9/2075* (2013.01); *E02F 9/2004* (2013.01); *E02F 9/2091* (2013.01);
(Continued)

(58) Field of Classification Search
CPC ..... E02F 9/2075; E02F 9/2004; E02F 9/2091; E02F 9/2221; E02F 9/2285; E02F 9/2296;
(Continued)

(56) References Cited

U.S. PATENT DOCUMENTS 4,955,344 A * 9/1990 Tatsumi ..... E02F 9/2296 123/352
6,009,365 A * 12/1999 Takahara ..... B60W 20/00 701/54
(Continued)

FOREIGN PATENT DOCUMENTS

JP 2004-48844 A 2/2004
JP 2004-150305 A 5/2004
(Continued)

OTHER PUBLICATIONS

Extended European Search Report issued in European Application No. 17798981.1 dated Apr. 22, 2020 (six pages).
(Continued)

*Primary Examiner* — Edwin J Toledo-Duran
(74) *Attorney, Agent, or Firm* — Crowell & Moring LLP

(57) ABSTRACT

A low idling controller (26A) switches an idling state flag from "clear" to "set" upon detecting a non-operation of an operating device (14). A rotational speed controller (26B) switches a rotational speed command from a set rotational speed by a rotational speed command device (27) to a low idling rotational speed based upon the idling state flag. At this time, an engine (8) drives in the low idling rotational speed lower than the set rotational speed. A gate controller (24) stops switching of an inverter (23) while the low idling controller (26A) is lowering a rotational speed of the engine (8).

2 Claims, 5 Drawing Sheets

(51) Int. Cl.
*E02F 3/32* (2006.01)
*E02F 9/22* (2006.01)

(52) U.S. Cl.
CPC ..... *E02F 3/32* (2013.01); *E02F 9/2221* (2013.01); *E02F 9/2285* (2013.01); *E02F 9/2292* (2013.01); *E02F 9/2296* (2013.01)

(58) Field of Classification Search
CPC ..... E02F 3/32; E02F 9/2292; B60W 20/40; B60W 20/13; B60W 30/192; F02N 11/0862; F02D 29/04; F02D 41/062
USPC ..... 180/65.28, 65.285, 65.265
See application file for complete search history.

(56) References Cited

U.S. PATENT DOCUMENTS

| | | | | |
|---|---|---|---|---|
| 7,570,021 | B2 * | 8/2009 | Togashi | B60W 20/13 320/130 |
| 9,127,765 | B2 * | 9/2015 | Eto | B60W 10/02 |
| 10,207,703 | B2 * | 2/2019 | Uji | F02D 41/062 |
| 2002/0103055 | A1 * | 8/2002 | Tani | B60W 10/18 477/115 |
| 2004/0088103 | A1 * | 5/2004 | Itow | B60W 10/06 701/110 |
| 2007/0138998 | A1 * | 6/2007 | Togashi | H02J 1/14 320/104 |
| 2007/0175429 | A1 | 8/2007 | Yanagida et al. | |
| 2009/0261761 | A1 * | 10/2009 | Yoshioka | B60L 3/003 318/139 |
| 2010/0064677 | A1 | 3/2010 | Kawaguchi et al. | |
| 2011/0073392 | A1 | 3/2011 | Collins et al. | |
| 2012/0072064 | A1 * | 3/2012 | Kumazaki | F16H 61/0213 701/22 |
| 2013/0211655 | A1 | 8/2013 | Ogata et al. | |
| 2014/0054902 | A1 * | 2/2014 | Kawaguchi | H02P 9/04 290/40 B |
| 2016/0152224 | A1 * | 6/2016 | Tabata | B60W 30/06 701/22 |
| 2017/0282907 | A1 * | 10/2017 | Uji | B60W 30/192 |
| 2017/0320483 | A1 * | 11/2017 | Ishihara | B60K 6/48 |
| 2018/0073593 | A1 * | 3/2018 | Kawamura | F16D 21/06 |
| 2021/0180293 | A1 * | 6/2021 | Ishijima | F02D 29/06 |

FOREIGN PATENT DOCUMENTS

| | | | |
|---|---|---|---|
| JP | 2012-92576 | A | 5/2012 |
| JP | 2014-169597 | A | 9/2014 |
| WO | WO 2015/125601 | A1 | 8/2015 |

OTHER PUBLICATIONS

Korean-language Office Action issued in counterpart Korean Application No. 10-2018-7024170 dated Sep. 18, 2019 with English translation (eight pages).
International Search Report (PCT/ISA/220 & PCT/ISA/210) issued in PCT Application No. PCT/JP2017/009171 dated May 30, 2017 with English translation (five pages).
Japanese-language Written Opinion (PCT/ISA/237) issued in PCT Application No. PCT/JP2017/009171 dated May 30, 2017 (three pages).

* cited by examiner

CONSTRUCTION MACHINE

TECHNICAL FIELD

The present invention relates to a construction machine provided with an engine (internal combustion engine) and an electric motor.

BACKGROUND ART

In general, a construction machine as a hydraulic excavator is provided with an engine using a gasoline, a light oil or the like as fuel, a hydraulic pump driven by the engine, hydraulic actuators composed of hydraulic motors, hydraulic cylinders and the like which are driven by pressurized oil delivered from the hydraulic pump, and an operating device including control levers/pedals configured to control flow amount and direction of the pressurized oil to the respective hydraulic actuators using control valves and the like.

On the other hand, there is also known a hybrid-type hydraulic excavator using both an engine and a generator motor together (refer to Patent Document 1). In this hybrid-type hydraulic excavator, for example, the generator motor and a hydraulic pump are mounted on an output shaft of the engine and an electricity storage device is provided to be electrically connected to the generator motor. The generator motor has an electric generator function of charging the electricity storage device with power generated by a driving force of the engine and an electric motor function of assisting in the engine by power running using power of the electricity storage device.

PRIOR ART DOCUMENT

Patent Document

Patent Document 1: Japanese Patent Laid-Open No. 2004-150305 A

SUMMARY OF THE INVENTION

Incidentally, an electricity storage device disclosed in Patent Document 1 lowers a rotational speed of an engine to a set rotational speed to improve fuel consumption of the engine and suppress noises from the engine when a vehicle is not operated by returning a control lever or the like back to a neutral position, for example. In some cases, however, switching of a power converter causes vibrations and noises to be generated in an electric motor. At this time, when the rotational speed of the engine is lowered, an engine sound is also lowered. Therefore, high-frequency noises from the electric motor are easy to be perceived, possibly giving uncomfortable feelings to an operator or the like.

The present invention is made in view of the above-mentioned problems in the conventional technology, and an object of the present invention is to provide a construction machine that lowers a rotational speed of an engine and can suppress noises of an electric motor when an operation of a vehicle is not performed.

For solving the above-mentioned problems, the present invention is applied to a construction machine comprising: an engine mounted on a vehicle; an electric motor connected mechanically to the engine; a hydraulic pump connected mechanically to the engine; an operating device configured to operate a movement of the vehicle; an electricity storage device connected electrically to the electric motor; and a power converter configured to convert a voltage of the electricity storage device, the power converter being switched to drive the electric motor, characterized in that: the construction machine comprises: a low idling controller configured to lower a rotational speed of the engine upon detecting a non-operation of the operating device; and a switching controller configured to stop the switching of the power converter when the low idling controller is in the middle of lowering the rotational speed of the engine.

According to the present invention, at the time of not operating the vehicle, the rotational speed of the engine is lowered and noises of the electric motor can be suppressed.

MODE FOR CARRYING OUT THE INVENTION

Hereinafter, a construction machine according to an embodiment in the present invention will be in detail explained with reference to the accompanying drawings, with an example of application thereof to a hybrid-type hydraulic excavator.

Figure 1:
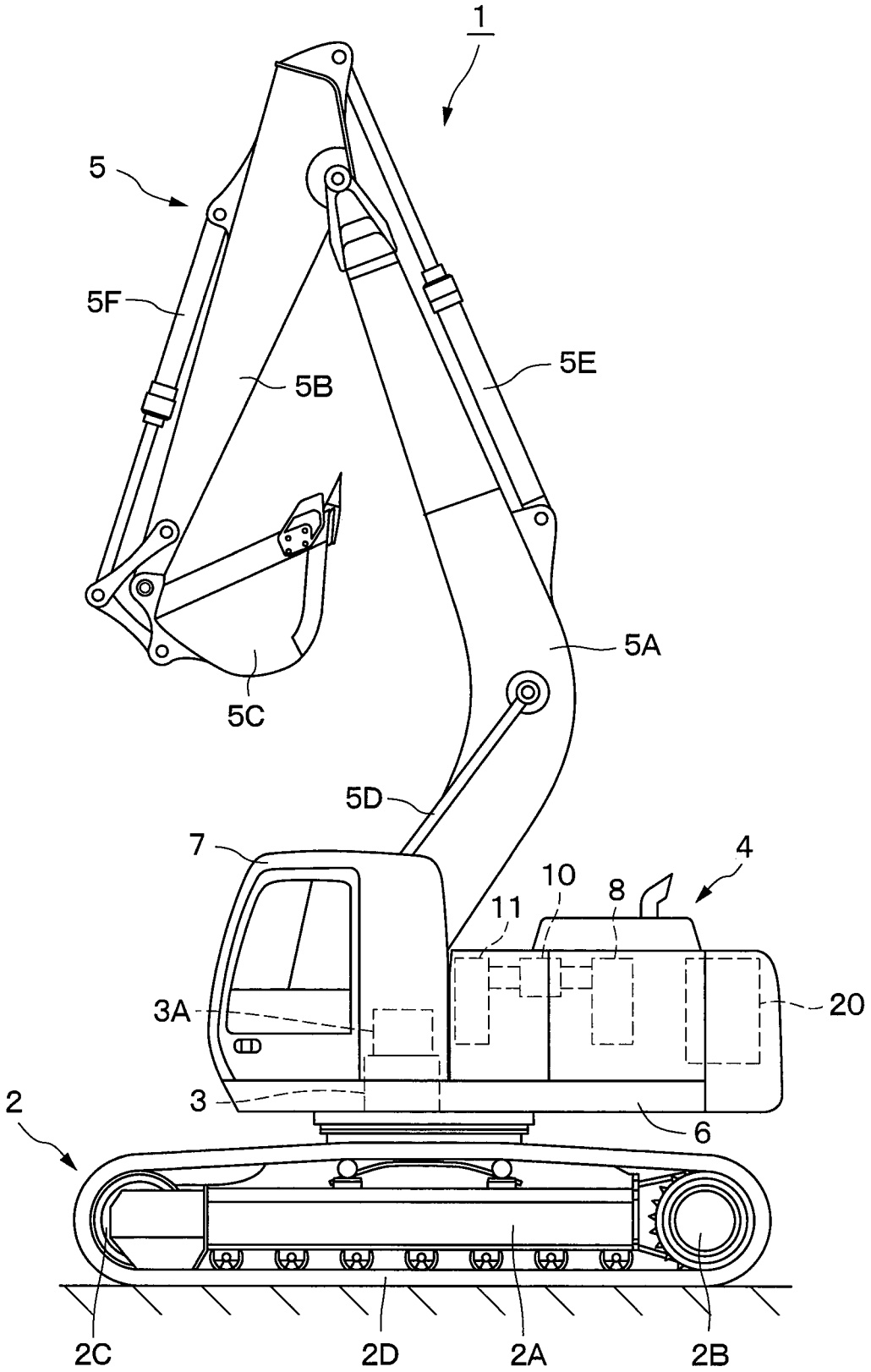
FIG. 1 is a front view showing a hydraulic excavator according to the present embodiment.

FIG. 1 to FIG. 5 show an embodiment of the present invention. In FIG. 1, a hybrid-type hydraulic excavator 1 (hereinafter, referred to as "hydraulic excavator 1") as a vehicle is a representative example of hybrid-type construction machines. The hybrid-type hydraulic excavator 1 includes an automotive lower traveling structure 2 of a crawler type, a revolving device 3 that is provided on the lower traveling structure 2, an upper revolving structure 4 that is mounted to be capable of revolving on the lower traveling structure 2 through the revolving device 3 and configures a vehicle body (base body) together with the lower traveling structure 2, and a working mechanism 5 that is provided in the front side of the upper revolving structure 4 to be capable of lifting and tilting thereto and performs an excavating operation of earth and sand, and the like.

The lower traveling structure 2 includes a truck frame 2A, drive wheels 2B provided on both left and right sides of the truck frame 2A in one of front and rear directions of the truck frame 2A, idler wheels 2C provided on both left and right sides of the truck frame 2A at the other side in the front and rear directions, and crawler belts 2D wound around and between the drive wheels 2B and the idler wheels 2C (only the left one in any component is shown).

The left and right drive wheels 2B are respectively driven and rotated by left and right traveling hydraulic motors 2E, 2F (refer to FIG. 2) as hydraulic actuators. On the other hand, the revolving device 3 is mounted on an upper side of a central part of the truck frame 2A.

The revolving device 3 is disposed on the lower traveling structure 2, and includes a deceleration device (not shown), a revolving hydraulic motor 3A and the like. The revolving device 3 is configured to revolve the upper revolving structure 4 relative to the lower traveling structure 2.

The working mechanism 5 includes a boom 5A mounted on a front side of a revolving frame 6 in the upper revolving structure 4 to be capable of lifting and tiling thereto, an arm 5B mounted on a tip part of the boom 5A to be capable of lifting and tiling thereto, a bucket 5C mounted on a tip part of the arm 5B to be rotatable thereto, and a boom cylinder 5D, an arm cylinder 5E and a bucket cylinder 5F, which are respectively composed of hydraulic cylinders (hydraulic actuators) for driving them.

The revolving frame 6 configures apart of the upper revolving structure 4 as a support structure. The revolving frame 6 is mounted to be capable of revolving on the lower traveling structure 2 through the revolving device 3. In addition, the revolving frame 6 is provided thereon with a cab 7, an engine 8, an assist generator motor 10, a hydraulic pump 11, an electricity storage device 20, an inverter 23, and the like.

The cab 7 is provided on a left front side of the revolving frame 6, and an operator's seat (not shown) on which an operator sits is provided within the cab 7. An operating device 14, a rotational speed command device 27 and the like are arranged on the periphery of the operator's seat.

The engine 8 is positioned in back of the cab 7 and is disposed on the revolving frame 6. The engine 8 is configured using, for example, a diesel engine, and is mounted on the upper revolving structure 4 in a horizontal state extending in the left-right direction as an internal combustion engine of the hybrid-type hydraulic excavator 1. The assist generator motor 10 and the hydraulic pump 11 are connected mechanically to the output side of the engine 8.

Here, an operation of the engine 8 is controlled by an engine control unit 9 (hereinafter, referred to as "ECU 9"). The ECU 9 uses, for example, a fuel injection device (not shown) to variably control a supply amount of fuel. That is, the ECU 9 variably controls an injection amount of fuel (fuel injection amount) to be injected into cylinders (not shown) of the engine 8 based upon a control signal (a rotational speed command by a rotational speed controller 26B) outputted from a main controller 26. Thereby, the engine 8 operates in a rotational speed corresponding to a drive operation by an operator, an operating state of a vehicle and the like. In addition, the ECU 9, when a stop operation of a key switch (not shown) is performed, stops fuel injection of the fuel injection device in response to a command of the main controller 26 and stops the engine 8.

The assist generator motor 10 is configured as an electric motor and is connected mechanically to and between the engine 8 and the hydraulic pump 11. The assist generator motor 10 is configured of, for example, a permanent magnet type synchronous electric motor. The assist generator motor 10 is driven/rotated by the engine 8 to generate power or assists in a drive of the engine 8 by supply of power. That is, the assist generator motor 10 has a function (an electric generator function) that is driven/rotated by the engine 8 to generate power and a function (an electric motor function) that assists in a drive of the engine 8 as an electric motor by supply of power through the inverter 23.

Generated power of the assist generator motor 10 is supplied to the inverter 23 and is charged (stored) in the electricity storage device 20. On the other hand, at the time of assisting in a drive of the engine 8, the assist generator motor 10 is driven by power charged in the electricity storage device 20.

The hydraulic pump 11 is connected mechanically to the engine 8 together with the assist generator motor 10 and a pilot pump 12. The hydraulic pump 11 is configured as a hydraulic source together with the pilot pump 12 and a hydraulic oil tank 13. The hydraulic pump 11 is configured of various types of hydraulic pumps such as a swash plate type, a bent axis type or a radial piston type. The hydraulic pump 11 is driven by the engine 8 and the assist generator motor 10. The hydraulic pump 11 serves as a power source for driving the hydraulic actuators of the traveling hydraulic motors 2E, 2F, the revolving hydraulic motor 3A, the cylinders 5D to 5F, and the like, and increases a pressure of the hydraulic oil in the hydraulic oil tank 13, which is delivered to a control valve 16.

The pilot pump 12 is provided to be connected to the hydraulic pump 11. The pilot pump 12 delivers pressurized oil for pilot (pilot pressure) to be supplied to the control valve 16 as a hydraulic signal at the time of operating the operating device 14.

The operating device 14 is positioned within the cab 7 and is connected to a flow control valve 15. The operating device 14 is configured by the traveling control lever/pedal, revolving and working control levers and the like (any thereof is not shown). By operating the flow control valve (pilot valve) 15 using the operating device 14, a flow amount and a direction of pressurized oil to be delivered from the pilot pump 12 are controlled to supply a pilot pressure to the control valve 16. Therefore, the control valve 16 is operated to switch/control a direction of the pressurized oil to the hydraulic motors 2E, 2F, 3A and the cylinders 5D to 5F. That is, the operating device 14 outputs the pilot pressure to the control valve 16 as a drive command to the hydraulic motors 2E, 2F, 3A and the cylinders 5D to 5F. As a result, the operating device 14 controls a traveling movement, a revolving movement, an excavating movement and the like of the hydraulic excavator 1.

The control valve 16 is provided on the revolving frame 6 and includes a plurality of directional control valves that control the hydraulic motors 2E, 2F, 3A and the cylinders 5D to 5F. The control valve 16 switches supply and discharge of the pressurized oil delivered from the hydraulic pump 11 in response to a drive command (pilot pressure) based upon an operation of the operating device 14 (controls a delivery amount and a delivery direction of the pressurized oil). Thereby, the pressurized oil delivered to the control valve 16 from the hydraulic pump 11 is distributed to the hydraulic motors 2E, 2F, 3A and the cylinders 5D to 5F respectively as needed to drive (rotate) the hydraulic motors 2E, 2F, 3A and drive (expand and contract) the cylinders 5D to 5F.

A gate lock lever 17 is configured as a lock device and is positioned within the cab 7 to be connected to a pilot cut valve 18. The gate lock lever 17 switches supply and stop of a pilot pressure to be supplied to the flow control valve 15. As a result, the gate lock lever 17 switches effectiveness and ineffectiveness of a drive command to the hydraulic motors 2E, 2F, 3A and the cylinders 5D to 5F by the operating device 14. When the gate lock lever 17 is moved to a lock position (raised position), the pilot cut valve 18 blocks off the pressurized oil from the pilot pump 12 to the flow control valve 15 to cause operations of the hydraulic motors 2E, 2F, 3A and the cylinders 5D to 5F through the flow control valve 15 to be incapable (non-operation). On the other hand, when the gate lock lever 17 is moved to a lock releasing position (lowered position), the pilot cut valve 18 supplies the pressurized oil from the pilot pump 12 to the flow control valve 15 to enable the hydraulic motors 2E, 2F, 3A and the cylinders 5D to 5F to operate through the operating device 14. It should be noted that the lock device is not limited to the gate lock lever 17 of a lever type rotating in an upper-lower direction, but may be configured of a component such various types of switches or pedals, for example.

A pilot pressure sensor 19 is positioned between the flow control valve 15 and the control valve 16 and is disposed downstream of the pilot cut valve 18. The pilot pressure sensor 19 is an operation detector configured to detect presence/absence of an operation of the operating device 14. The pilot pressure sensor 19 is configured by a pressure sensor that detects a pilot pressure outputted from the pilot pump 12. That is, the pilot pressure sensor 19 detects presence/absence of the operation of the operating device 14 based upon whether the pilot pressure is higher or lower than a predetermined pressure value and outputs the detection result to the main controller 26.

The electricity storage device 20 is disposed on the revolving frame 6 and is connected electrically to the assist generator motor 10 through the inverter 23. The electricity storage device 20 stores power and is configured using a secondary battery such as a lithium ion battery or a nickel hydrogen battery, for example. That is, the electricity storage device 20 is charged (stored) by generated power generated by the assist generator motor 10, or discharges (supplies) the charged power to the assist generator motor 10.

Here, the electricity storage device 20 is provided with a battery control unit 21 (hereinafter, referred to as "BCU 21"). The BCU 21 is configured as a power remaining amount detector. Therefore, the BCU 21 detects a state of charge (SOC: State Of Charge) as a power remaining amount in the electricity storage device 20 to be outputted to the main controller 26.

In addition, the electricity storage device 20 is provided with a temperature sensor 22. The temperature sensor 22 is configured of a temperature detector such as a thermistor to detect a temperature T of the electricity storage device 20. The temperature sensor 22 is connected to the main controller 26, and the temperature T of the electricity storage device 20 detected by the temperature sensor 22 is outputted to the main controller 26 as a detection signal (for example, a change in resistance). In this case, the temperature sensor 22 detects whether or not a warming operation of the electricity storage device 20 is required.

Next, an explanation will be made of the configuration of an electric system of the hybrid-type hydraulic excavator 1.

Figure 2:
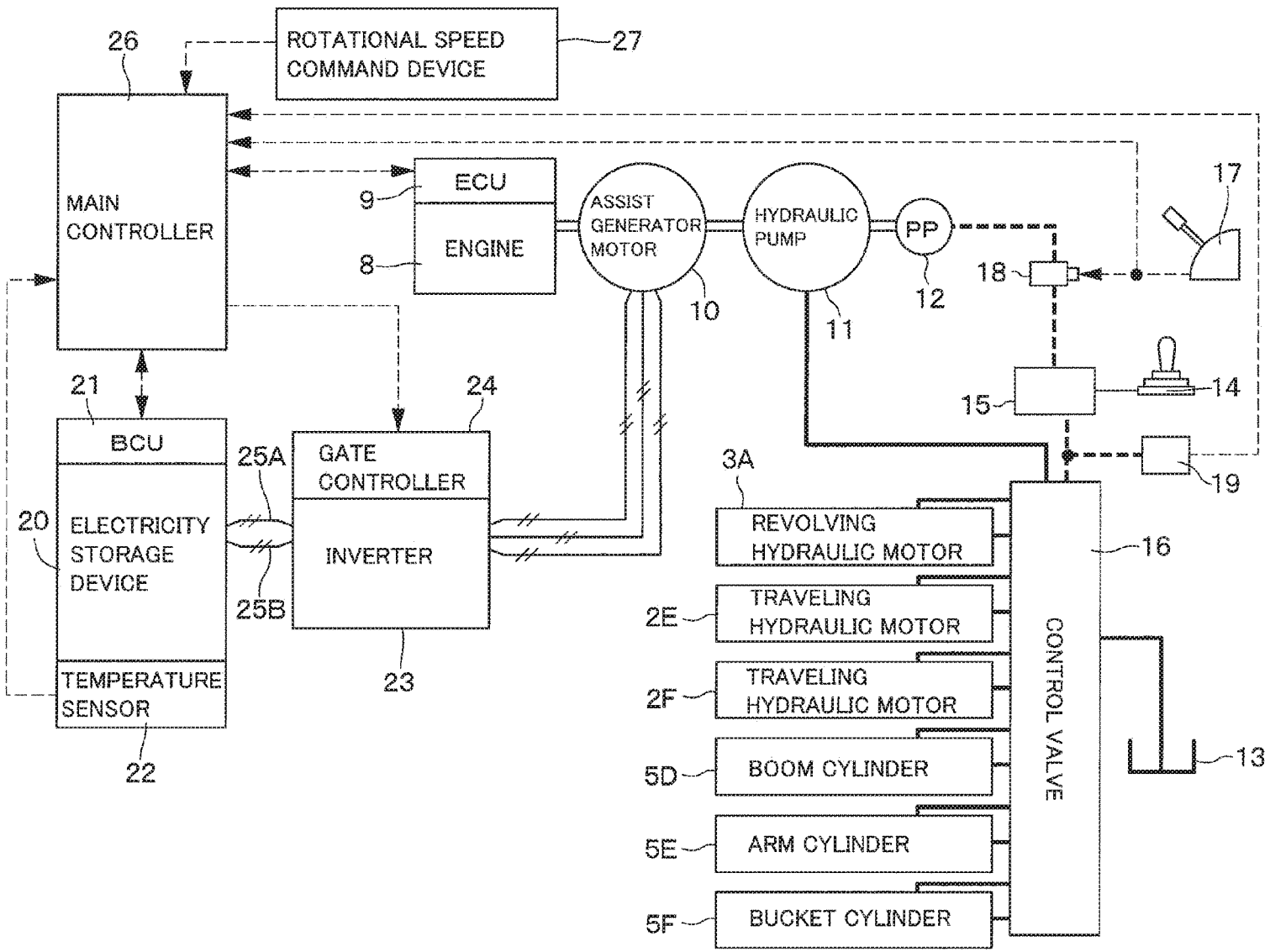
FIG. 2 is a block diagram showing the configuration of an electric system and a hydraulic system in the hydraulic excavator.

As shown in FIG. 2, the electric system of the hydraulic excavator 1 includes the assist generator motor 10 and the electricity storage device 20 as mentioned above, and further, the inverter 23, a gate controller 24, and the like. The inverter 23 is mounted on the upper revolving structure 4, a switching operation of which is controlled by the gate controller 24. The inverter 23 converts a voltage from the electricity storage device 20 to drive the assist generator motor 10 or converts a voltage from the assist generator motor 10 to charge the electricity storage device 20.

The inverter 23 is configured as a power converter. The inverter 23 is connected electrically to the assist generator motor to control a drive of the assist generator motor 10. Specifically, the inverter 23 is configured using a plurality of switching elements (for example, six elements) such as a transistor, or an insulating gate bipolar transistor (IGBT), and is connected to a pair of DC buses 25A, 25B. An opening/closing operation of the switching element of the inverter 23 is controlled by a three-phase (U phase, V phase and W phase) PWM signal (gate voltage signal) outputted from the gate controller 24. At the power generation of the assist generator motor 10, the inverter 23 converts generated power generated by the assist generator motor 10 into DC power, which is supplied to the DC buses 25A, 25B. On the other hand, at the motor drive time of the assist generator motor 10, the inverter 23 generates AC power of three phases from the DC power of the DC buses 25A, 25B, which is supplied to the assist generator motor 10.

The gate controller 24 is mounted on the upper revolving structure 4 as a switching controller. The gate controller 24 has an input side that is connected to the main controller 26, and an output side that is connected to the inverter 23. The gate controller 24 generates the three-phase PWM signal based upon a control command (output command) from the main controller 26. Therefore, the gate controller 24 controls generated power at the power generation and drive power at the power running of the assist generator motor 10.

In addition, the gate controller 24 receives an idling state flag from a low idling controller 26A in the main controller 26. The gate controller 24 controls whether or not the switching of the inverter 23 is performed based upon the idling state flag. That is, in a case where the idling state flag is put to "clear", the gate controller 24 puts the inverter 23 in an ON-state as a state where the inverter 23 performs the switching operation. Since the gate controller 24 outputs the three-phase PWM signal in this ON-state, the inverter 23 performs the switching operation based upon the three-phase PWM signal. On the other hand, in a case where the idling state flag is put to "set", the gate controller 24 puts the inverter 23 in an OFF-state as a state where the inverter 23 stops the switching operation. Since the gate controller 24 outputs a signal of stopping the switching element in this OFF-state, the switching element of the inverter 23 is fixed to be open (OFF) to stop the switching operation.

The inverter 23 is connected at a plus side and at a minus side to the electricity storage device 20 through a pair of the DC buses 25A, 25B. For example, a smoothing capacitor (not shown) is connected to the DC buses 25A, 25B. A predetermined DC voltage of, for example, approximately several hundred volts is applied to the DC buses 25A, 25B.

Figure 3:
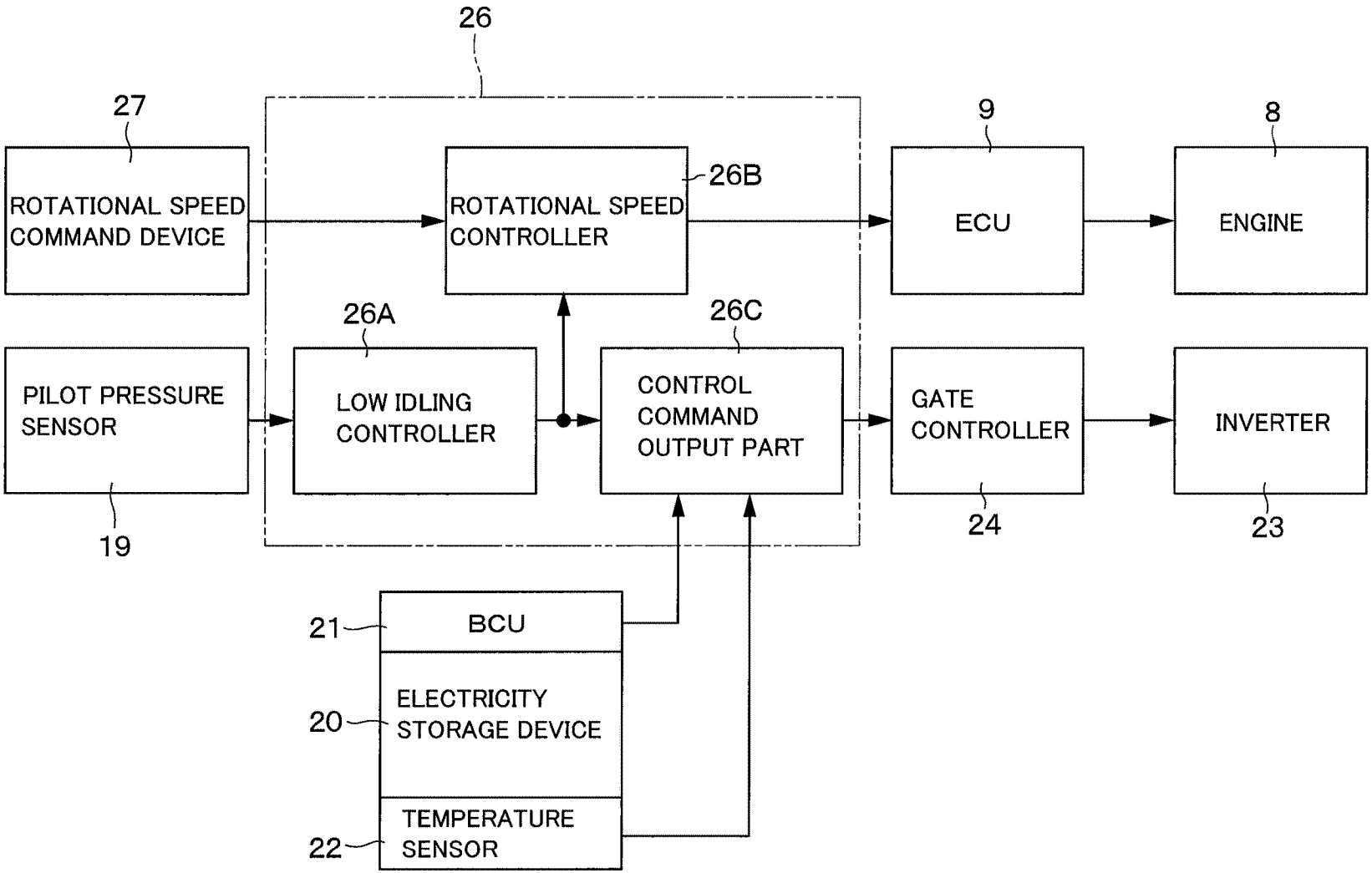
FIG. 3 is a block diagram showing a main controller in FIG. 2.

In FIG. 3, the main controller 26 is provided within the cab 7, for example, and is connected to the ECU 9, the BCU 21, the gate controller 24 and the like. The main controller 26 is configured of, for example, a microcomputer and the like, and is provided with the low idling controller 26A, the rotational speed controller 26B, a control command output part 26C and the like. The main controller 26 generates control commands to the ECU 9, the BCU 21, the gate controller 24 and the like. The main controller 26 performs the low idling control of the engine 8, the drive control of the assist generator motor 10, the temperature monitoring of the electricity storage device 20, and control of the energy management and the like, based upon control commands.

Figure 4:
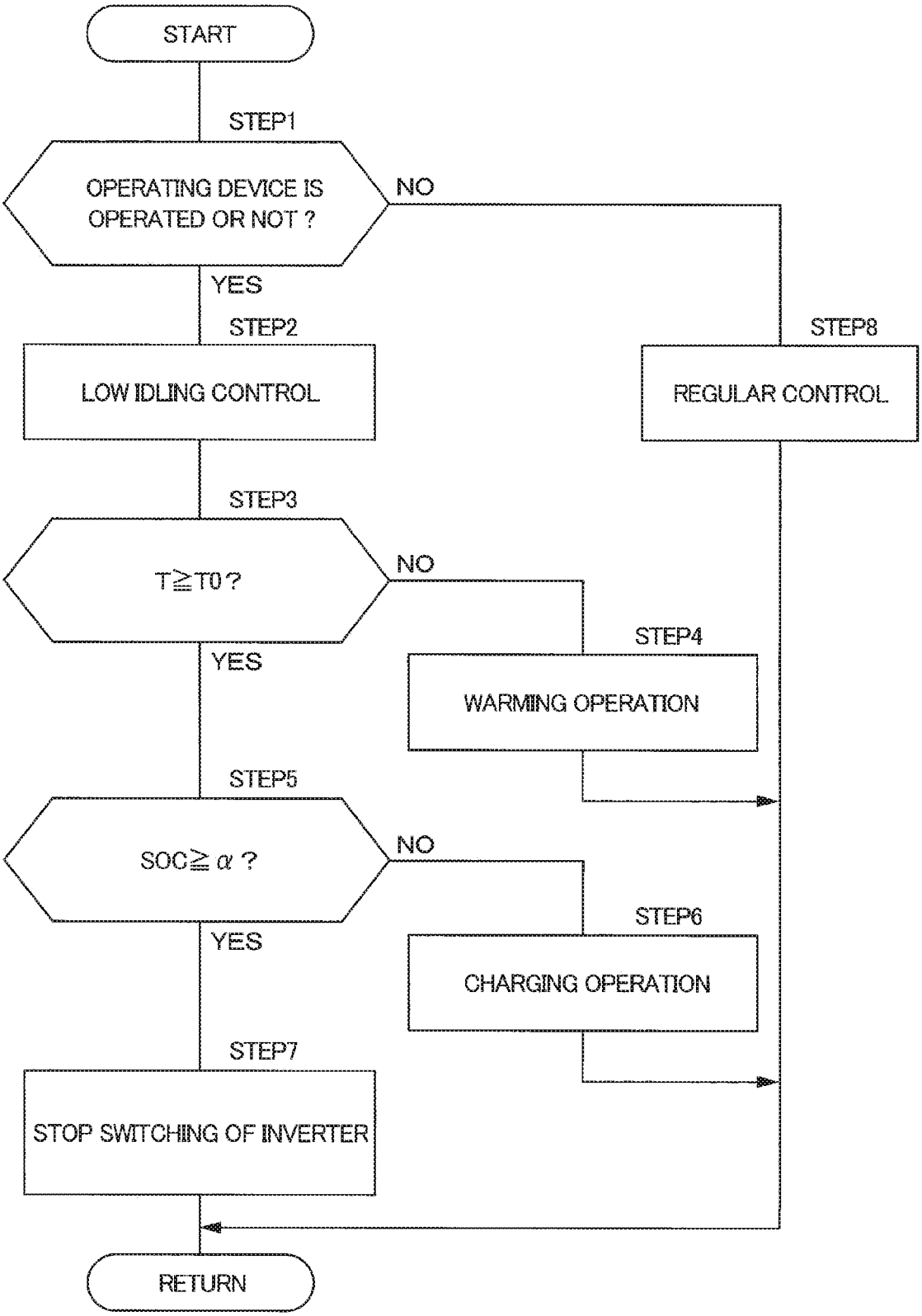
FIG. 4 is a flow chart showing low idling control processing by the main controller in FIG. 3.

In addition, the main controller 26 is provided with a memory part (not shown) that stores programs of low idling control processing shown in FIG. 4, and the like. Thereby, the main controller 26, at the non-operation of the operating device 14, performs the low idling control to lower the rotational speed of the engine 8 and stops the switching of the inverter 23.

The low idling controller 26A has an input side that is connected to the pilot pressure sensor 19 and an output side that is connected to the rotational speed controller 26B and the control command output part 26C. The low idling controller 26A puts the idling state flag to "clear" at a regular time. On the other hand, the low idling controller 26A, when the non-operation of the operating device 14 is detected, puts the idling state flag to "set" after a constant time (time between time t1 and time t2). That is, in a case where the pilot pressure sensor 19 does not detect an increase in the pilot pressure, the operating device 14 is not performed. At this time, the low idling controller 26A puts the idling state flag to "set". The low idling controller 26A outputs the idling state flag to the rotational speed controller 26B and the control command output part 26C.

The rotational speed controller 26B has an input side that is connected to the low idling controller 26A and the rotational speed command device 27. The rotational speed controller 26B has an output side that is connected to the ECU 9 of the engine 8. The rotational speed controller 26B outputs a rotational speed command of the engine 8 based upon the idling state flag of the low idling controller 26A and the set rotational speed of the rotational speed command device 27. In this case, the rotational speed controller 26B, when the idling state flag is to "clear", outputs the set rotational speed set by the rotational speed command device 27 as a rotational speed command. Thereby, the ECU 9 controls the engine 8 in such a manner that the engine rotational speed is in agreement with the set rotational speed. On the other hand, the rotational speed controller 26B, when the idling state flag is put to "set", outputs a low idling speed lower than an engine rotational speed (set rotational speed) at the time the vehicle performs various movements, as the rotational speed command. Thereby, the ECU 9 controls the engine 8 in such a manner that the engine rotational speed is in agreement with the low idling rotational speed.

The control command output part 26C has an input side that is connected to the low idling controller 26A, the BCU 21 and the temperature sensor 22. The control command output part 26C has an output side that is connected to the gate controller 24. The control command output part 26C outputs a control command to the gate controller 24 based upon the idling state flag from the low idling controller 26A, the SOC of the electricity storage device 20 from the BCU 21 and the temperature T of the electricity storage device 20 from the temperature sensor 22. When the idling state flag is put to "clear", the control command output part 26C calculates generated power or motor output torque required of the assist generator motor 10 in response to an operating amount of the operating device 14 or the like for example, and outputs a control command corresponding to the calculation result to the gate controller 24. On the other hand, when the idling state flag is put to "set", the control command output part 26C determines whether a warming drive operation or charging operation of the battery is required based upon the SOC and the temperature T of the electricity storage device 20. When it is determined that any operation of the warming drive operation and charging operation of the battery is required, the control command output part 26C outputs a control command in response to the required operation to the gate controller 24. When it is determined that both of the warming drive operation and charging operation of the battery are not required, the control command output part 26C outputs a control command for stopping the switching of the inverter 23 to the gate controller 24.

The rotational speed command device 27 is provided within the cab 7 of the hydraulic excavator 1 and is configured by an operating dial, an up-down switch or an engine lever (none of them is shown), which are respectively operated by an operator, and the like. The rotational speed command device 27 commands the set rotational speed of the engine 8 and outputs a command signal of the set rotational speed in response to an operation of an operator to the rotational speed controller 26B in the main controller 26.

The hydraulic excavator 1 according to the present embodiment has the configuration as described above, and next, an explanation will be made of movements thereof.

First, an operator gets in the cab 7 and is seated on the operator's seat and rotates the unillustrated key switch to a START position in a state of fixing the gate lock lever 17 to the lock position. Thereby, fuel is supplied to the engine 8, starting up the engine 8. When the engine rotational speed reaches more than a predetermined rotational speed (for example, an idling rotational speed) and the engine 8 becomes in an engine start completion state, the operator switches the gate lock lever 17 from the lock position to the lock releasing position. In this state, when the operator operates the traveling control lever/pedal of the operating device 14, the pressurized oil delivered through the control valve 16 from the hydraulic pump 11 is supplied to the traveling hydraulic motors 2E, 2F of the lower traveling structure 2. Thereby, the hydraulic excavator 1 performs a traveling movement of a forward travel, a backward travel or the like. In addition, when the operator operates the working control lever of the operating device 14, the pressurized oil delivered through the control valve 16 from the hydraulic pump 11 is supplied to the revolving hydraulic motor 3A and the cylinders 5D to 5F. Thereby, the hydraulic excavator 1 performs a revolving movement, an excavating movement by a lifting/tilting movement of the working mechanism 5, or the like.

Figure 5:
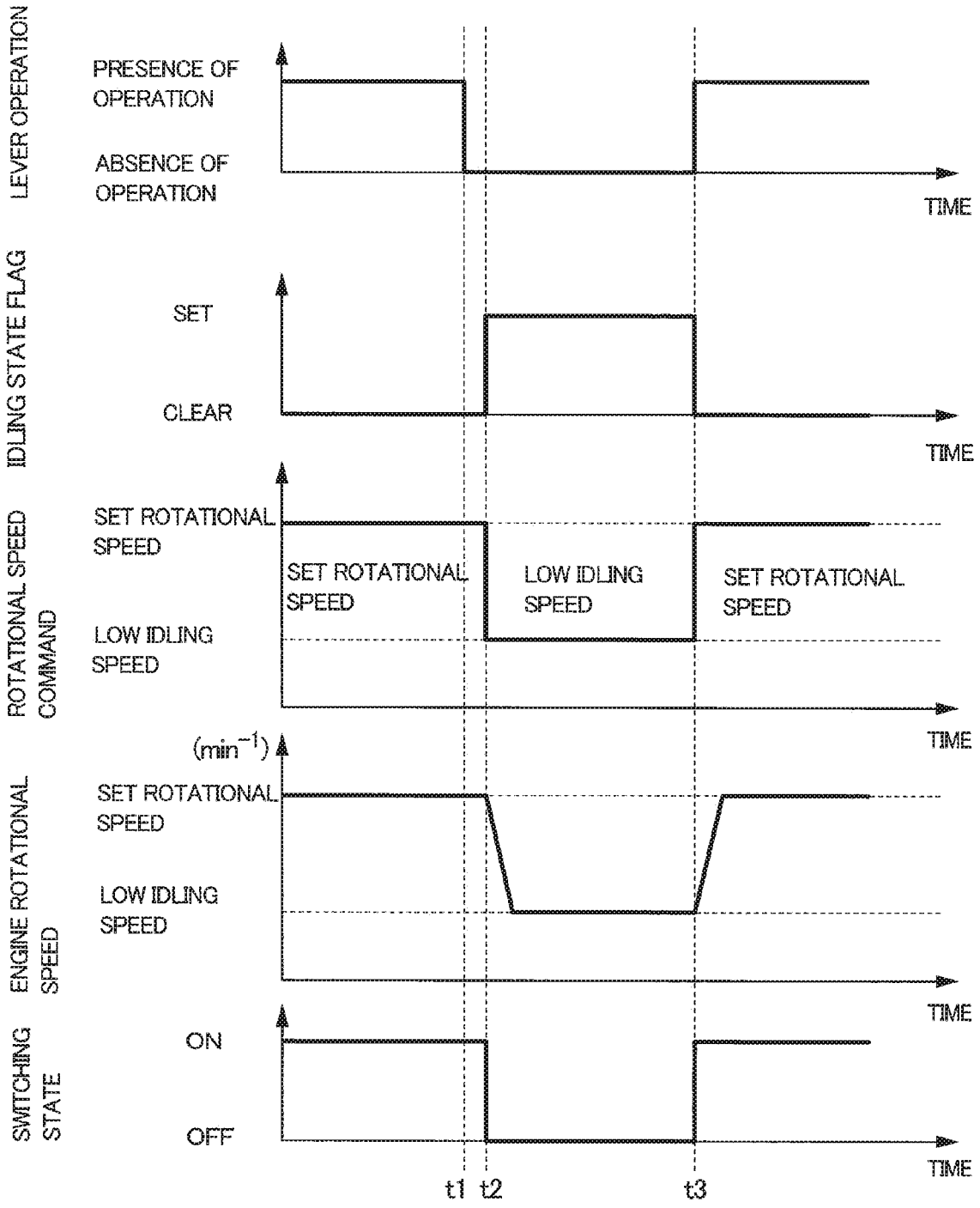
FIG. 5 is a characteristic line diagram showing an example of a change in a lever operation, an idling state flag, a rotational speed command, a rotational speed of an engine, and a switching state over time in the present embodiment.

Next, an explanation will be made of the low idling control processing to be executed by the main controller 26 with reference to FIG. 4 and FIG. 5. The low idling control processing is repeatedly executed in a predetermined control cycle while the main controller 26 is driving.

First, at step 1, it is determined whether or not an operation by the operating device 14 is performed. In this case, presence/absence of the operation of the operating device 14 is detected based upon determination whether a pilot pressure is higher or lower than a predetermined pressure value using the pilot pressure sensor 19. Specifically, the low idling controller 26A in the main controller 26 determines that the operation of the operating device 14 is not performed, based upon an event that the non-operation of the operating device 14 continues for a constant time (for example, about one second). Here, step 1 corresponds to an operation determining element.

In a case where "NO" determination is made at step 1, since the operation of the operating device 14 is determined to be performed, the process goes to step 8. At step 8, the main controller 26 performs a regular control for setting the engine rotational speed to a set rotational speed commanded by the rotational speed command device 27. That is, when the low idling controller 26A receives a signal that the operating device 14 is in the middle of operating from the pilot pressure sensor 19, the low idling controller 26A puts the idling state flag to "clear". Thereby, the rotational speed controller 26B sets the rotational speed command to the set rotational speed commanded by the rotational speed command device 27 in response to the idling state flag. As a result, The ECU 9 controls the engine 8 in such a manner that the engine rotational speed is in agreement with the set rotational speed.

In addition, in the regular control, the gate controller 24 sets the inverter 23 to an ON-state and outputs the three-phase PWM signal in response to a control command from the control command output part 26C in the main controller 26. Thereby, the inverter 23 performs the switching operation in response to the three-phase PWM signal. When step 8 is completed, the process returns. Here, step 8 corresponds to a regular control element.

On the other hand, in a case where "YES" determination is made at step 1, when a time from time t1 to time t2 in FIG.

5 elapses since then, the process goes to step 2. At step 2, the main controller 26 performs a low idling control for lowering the engine rotational speed. That is, when the low idling controller 26A receives a signal that the operation of the operating device 14 is not performed from the pilot pressure sensor 19, the low idling controller 26A puts the idling state flag to "set". Thereby, the rotational speed controller 26B sets the rotational speed command to the low idling rotational speed in response to the idling state flag. As a result, the ECU 9 controls the engine 8 in such a manner that the engine rotational speed is in agreement with the low idling rotational speed. Here, step 2 corresponds to a low idling control element.

At subsequent step 3, the control command output part 26C determines whether or not the temperature T of the electricity storage device 20 is greater than a preset threshold value TO. Here, the electricity storage device 20 has a predetermined temperature range appropriate for use in terms of deterioration in electrical performance, durability and the like. Therefore, the control command output part 26C determines whether or not the temperature T detected by the temperature sensor 22 falls below a lower limit value (threshold value TO) in the predetermined temperature range of the electricity storage device 20. That is, this step 3 corresponds to a temperature determining element.

In a case where "NO" determination is made at step 3, since the temperature T of the electricity storage device 20 is less than the threshold value TO, the process goes to step 4. At step 4, since the temperature T of the electricity storage device 20 is lower than the threshold value TO, the control command output part 26C outputs a control command for performing a warming operation of the electricity storage device 20. At this time, the gate controller 24 performs the switching of the inverter 23 to alternately perform the discharge/charge of the electricity storage device 20. This causes internal losses to be generated in the electricity storage device 20, thus making it possible to heat the electricity storage device 20 itself and increase the temperature T of the electricity storage device 20. In this case, the process returns after the warming operation of the electricity storage device 20 is started. Here, step 4 corresponds to a warming operation element.

On the other hand, in a case where "YES" determination is made at step 3, since the temperature T of the electricity storage device 20 is equal to or more than the threshold value TO, the process goes to step 5. At step 5, the control command output part 26C determines whether or not the SOC of the electricity storage device 20 detected by the BCU 21 is greater than an appropriate value α (a lower limit value in a SOC range required at the idling time, which is hereinafter omitted) of about 60%, for example. Here, the electricity storage device 20 has an appropriate charge/discharge range of SOC (for example, SOC=approximately 30 to 70%) appropriate for use in terms of deterioration in electrical performance, durability and the like. The charge/discharge range of the SOC is not limited to the exemplified value, but may be optionally set according to a specification of the electricity storage device 20 or the like. Therefore, the control command output part 26C determines whether or not the SOC of the electricity storage device 20 detected by the BCU 21 falls below the appropriate value α in the charge/discharge range of the electricity storage device 20. It should be noted that the appropriate value α of the electricity storage device 20 is not necessarily the lower limit value in the appropriate charge/discharge range of the SOC, but may be a different value. The appropriate value a may be optionally set according to use of a vehicle, for example, or the like. Here, step 5 corresponds to an SOC determining element.

In a case where "NO" determination is made at step 5, since the SOC is less than the appropriate value α, the process goes to step 6. At step 6, since the SOC of the electricity storage device 20 falls below the appropriate value α, the control command output part 26C outputs a control command for a charging operation of the electricity storage device 20. At this time, the gate controller 24 performs the switching of the inverter 23 to perform a power generating operation of the assist generator motor 10 by the engine 8. Thereby, the charge of the electricity storage device 20 can be made by the generated power of the assist generator motor 10 to increase the SOC. In this case, after the charging operation of the electricity storage device 20 is started, the process returns. Here, step 6 corresponds to a charging operation element.

On the other hand, in a case where "YES" determination is made at step 5, since the SOC is equal to or more than the appropriate value α, the process goes to step 7. At step 7, the control command output part 26C outputs a control command for stopping the switching of the inverter 23 toward the gate controller 24. Thereby, the gate controller 24 fixes all the switching elements of the inverter 23 to an OFF-state to stop the switching of the inverter 23. When the processing of step 7 is completed, the process returns. Here, step 7 corresponds to a switching stopping element.

Next, an explanation will be made of a change in a lever operation, an idling state flag, a rotational speed command, an engine rotational speed, and a switching state over time with reference to a characteristic line diagram shown in FIG. 5.

First, in a case where an operation of the operating device 14 is performed, the lever operation is determined as "presence of the operation" and the low idling controller 26A puts the idling state flag to "clear". In this case, the rotational speed controller 26B sets the rotational speed command to the set rotational speed set by the rotational speed command device 27. The gate controller 24 sets the switching state of the inverter 23 to "ON" to drive the assist generator motor 10 in response to a control command from the main controller 26.

Next, in a case where an operator stops the operation of the operating device 14 at time t1, the lever operation comes to "absence of the operation". In addition, at time t2 when a constant time elapses, the low idling controller 26A switches the idling state flag from "clear" to "set". Thereby, the rotational speed controller 26B switches the rotational speed command from the set rotational speed to the low idling rotational speed to lower the engine rotational speed to the low idling speed. In this case, the gate controller 24 changes the switching state of the inverter 23 from "ON" to "OFF".

In a case where an operator restarts the operation of the operating device 14 at time t3, the lever operation comes to "presence of the operation" and the low idling controller 26A switches the idling state flag from "set" to "clear". In addition, the rotational speed controller 26B switches the rotational speed command from the low idling rotational speed to the set rotational speed to increase the engine rotational speed to the set rotational speed by the rotational speed command device 27. Thereby, the gate controller 24 returns the switching state of the inverter 23 to "ON" to drive the assist generator motor 10 in response to a control command from the main controller 26. As a result, the assist generator motor 10 can be driven without posing any problem for the operation of the hydraulic excavator 1.

In this way, according to the present embodiment, the hydraulic excavator 1 is provided with the low idling controller 26A that lowers the rotational speed of the engine 8 upon detecting the non-operation of the operating device 14, and the gate controller 24 that stops the switching of the inverter 23 while the low idling controller 26A is lowering the rotational speed of the engine 8. Thereby, when the operating device 14 is in the non-operating state, the engine rotational speed can be lowered to a low rotational speed and vibrations of the assist generator motor 10 to be caused by the switching of the inverter 23 can be suppressed. As a result, in the middle of performing the low idling control in which the rotational speed of the engine 8 lowers, it is possible to suppress high-frequency noises to be generated from the assist generator motor 10.

In addition, the hydraulic excavator 1 is provided with the BCU 21 that detects the SOC of the electricity storage device 20. Thereby, when the SOC detected by the BCU 21 falls below the appropriate value $\alpha$ in the charge/discharge range of the electricity storage device 20, even in a case where the operating device 14 is in the non-operating state, it is possible to perform the switching of the inverter 23. As a result, it is possible to perform the power generating operation of the assist generator motor 10 even in the middle of performing the low idling control, and making it possible to increase the SOC of the electricity storage device 20 and ensure the required SOC.

In addition, the electricity storage device 20 is provided with the temperature sensor 22 that detects a temperature T of the electricity storage device 20. Thereby, when the temperature T of the electricity storage device 20 is lower than a preset threshold value TO, it is possible to perform the switching of the inverter even in a case where the operating device 14 is in the non-operating state. As a result, even in the middle of performing the low idling control, a battery warming drive of repeatedly performing the charge and discharge of the electricity storage device 20 can be performed to increase the temperature T of the electricity storage device 20 to a predetermined temperature range.

It should be noted that the present embodiment is configured to determine whether or not the operation by the operating device 14 is performed using the pilot pressure sensor 19. The present invention is not limited thereto, but may be configured to determine that an operation by an operating device is not performed in a case where the gate lock lever is moved to the lock position (raised position), for example.

The present embodiment is explained with the example in which the electricity storage device 20 is formed of the secondary battery. The present invention is not limited thereto, but an electricity storage device may be configured using a capacitor of an electric double layer.

The present embodiment is explained with the example in which the power converter is formed of the inverter 23. The present invention is not limited thereto, but a power converter may be configured using an inverter and a chopper increasing and decreasing a DC power.

The present embodiment is configured such that the gate controller 24 and the main controller 26 are separately provided. The present invention is not limited thereto, but a main controller may be provided with a gate controller. In addition, the present embodiment is explained with the example using the gate controller 24 that controls the gate voltage of the switching element in the inverter 23 as the switching controller. The present invention is not limited thereto, but, for example in a case where a switching element is formed of a bipolar transistor, a switching controller may be configured of a current controller that controls a base current. That is, the switching controller may adopt any structure as long as an on/off operation of the switching element can be controlled.

The present embodiment is explained with the example where the automotive hydraulic excavator 1 of a crawler type is used as the construction machine. However, the present invention is not limited thereto, but the present invention may be applied to an automotive wheel type hydraulic excavator, a mobile crane, and further, a stationary excavator, a crane or the like in which a revolving structure is mounted on a non-traveling base body to be capable of revolving thereon. In addition, the present invention may be widely applied to various types of working vehicles, working machines and the like that are not equipped with a revolving structure, such as wheel loaders or fork lifts, as the construction machine.

DESCRIPTION OF REFERENCE NUMERALS

1: Hydraulic excavator (Vehicle)
8: Engine
10: Assist power generator motor (Electric motor)
11: Hydraulic pump
14: Operating device
20: Electricity storage device
21: BCU (Power remaining amount detector)
23: Inverter (Power converter)
24: Gate controller (Switching controller)
26A: Low idling controller

The invention claimed is:

1. A construction machine comprising:
an engine mounted on a vehicle;
an assist generator motor connected mechanically to the engine;
a hydraulic pump connected mechanically to the engine;
an operating device configured to operate a movement of the vehicle;
an electricity storage device connected electrically to the electric motor;
a power converter configured to:
convert a voltage of the electricity storage device,
perform a switching operation to drive the assist generator motor; and
convert a voltage from the assist generator motor to charge the electricity storage device;
a low idling controller configured to lower a rotational speed of the engine upon detecting non-operation of the operating device;
a switching controller configured to stop the switching operation of the power converter when the low idling controller is in the middle of lowering the rotational speed of the engine; and
a power remaining amount detector configured to detect a remaining amount of power in the electricity storage device, wherein
the switching controller is further configured to control the switching operation of the power converter to perform a power generating operation of the assist generator motor when:
(1) the low idling controller is in the middle of lowering the rotational speed of the engine, and
(2) the remaining amount of power detected by said power remaining amount detector falls below an appropriate value in a charge/discharge range of the electricity storage device.

2. The construction machine according to claim 1, wherein said switching controller controls the switching of said power converter to alternately perform the discharge/charge of the electricity storage device when;

(1) the low idling controller is in the middle of lowering the rotational speed of the engine, and a temperature of said electricity storage device is lower than a preset threshold value.

* * * * *